US009260883B2

(12) United States Patent
Räty et al.

(10) Patent No.: US 9,260,883 B2
(45) Date of Patent: Feb. 16, 2016

(54) CYLINDER LOCK

(71) Applicant: Abloy Oy, Joensuu (FI)

(72) Inventors: Jari Räty, Joensuu (FI); Marko Kokkonen, Joensuu (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 14/460,774

(22) Filed: Aug. 15, 2014

(65) Prior Publication Data

US 2015/0047400 A1 Feb. 19, 2015

(30) Foreign Application Priority Data

Aug. 15, 2013 (FI) ..... 20135833

(51) Int. Cl.

*E05B 27/00* (2006.01)
*E05B 5/02* (2006.01)
*E05B 13/10* (2006.01)

(52) U.S. Cl.

CPC ..... *E05B 27/0003* (2013.01); *E05B 5/003* (2013.01); *E05B 13/108* (2013.01); *E05B 27/0046* (2013.01); *Y10T 70/7593* (2015.04)

(58) Field of Classification Search

CPC ..... E05B 13/108; E05B 27/0003; E05B 27/0046; E05B 5/003
USPC ..... 70/360, 379 R, 387, 490, DIG. 20
See application file for complete search history.

(56) References Cited

U.S. PATENT DOCUMENTS

| | | | | | |
|---|---|---|---|---|---|
| 1,907,625 | A * | 5/1933 | Vogt | 70/100 |
| 1,947,282 | A * | 2/1934 | Theis | 74/553 |
| 1,951,418 | A * | 3/1934 | Jacobi | 70/360 |
| 1,965,939 | A * | 7/1934 | Jacobi | 70/81 |
| 2,683,978 | A * | 7/1954 | Jacobi | 70/360 |
| 3,402,578 | A * | 9/1968 | Atkinson | 70/70 |
| 3,438,227 | A * | 4/1969 | Wolniak | 70/208 |
| 3,659,444 | A * | 5/1972 | Wellekens | 70/360 |
| 3,919,866 | A * | 11/1975 | Lipschutz | 70/81 |
| 4,306,431 | A * | 12/1981 | Craig | 70/79 |
| 6,098,434 | A * | 8/2000 | Liou | 70/360 |
| 6,575,503 | B1 * | 6/2003 | Johansson et al. | 292/170 |
| 6,872,905 | B2 * | 3/2005 | Kuepper et al. | 200/430 |
| 6,964,184 | B1 * | 11/2005 | Gregory | 70/360 |
| 7,409,842 | B2 * | 8/2008 | Kuo | 70/58 |
| 8,561,441 | B2 * | 10/2013 | Herrmann et al. | 70/162 |
| 2002/0078722 | A1 * | 6/2002 | Corey | 70/208 |
| 2011/0120200 | A1 * | 5/2011 | Eriksson | 70/449 |

FOREIGN PATENT DOCUMENTS

| | | |
|---|---|---|
| EP | 1435422 | * 7/2004 |
| GB | 1175663 | * 12/1969 |

* cited by examiner

*Primary Examiner* — Suzanne Barrett
(74) *Attorney, Agent, or Firm* — Muncy, Geissler, Olds & Lowe PC

(57) ABSTRACT

A cylinder lock used for locking compartments, boxes, storages etc. The cylinder lock comprises a cylinder body, an inner cylinder and a rotating part. The front part of the inner cylinder is provided with a rotary knob. The lock cylinder comprises a spring, which is arranged to push the rotary knob outwards. When the cylinder lock is locked, the rotary knob is in the inner position primarily inside the cylinder lock. When the cylinder lock is unlocked, the rotary knob is in the outer position as pushed by a spring, in which position it can be rotated to close and open a box, storage etc. without a key.

11 Claims, 4 Drawing Sheets

CYLINDER LOCK

TECHNICAL FIELD

Figure 1:
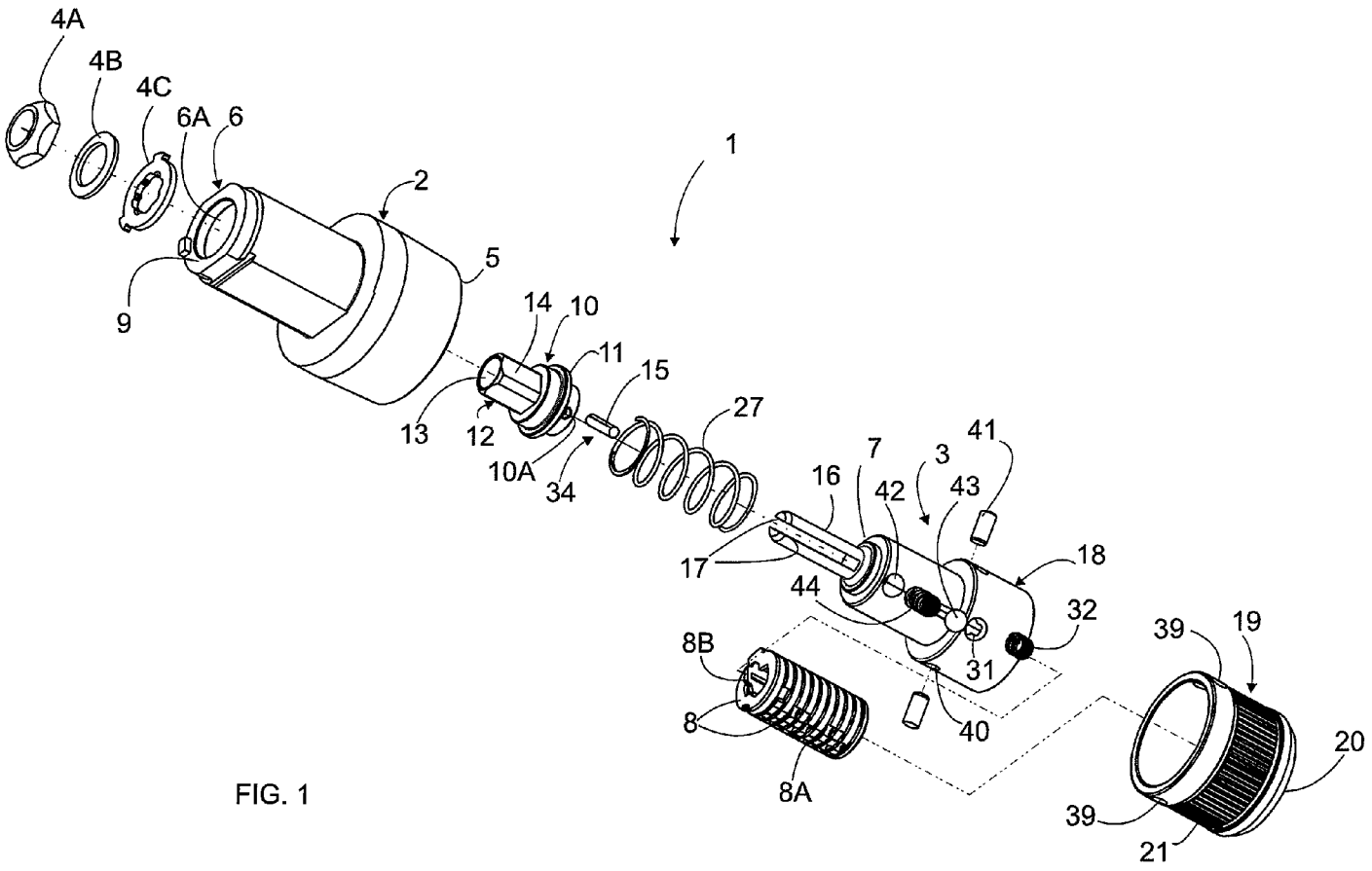

The invention relates to a cylinder lock. In particular, the invention relates to a cylinder lock, intended for locking of different storages, boxes, lockers and compartments.

PRIOR ART

Different compartments, storages and boxes can be locked using an ordinary cylinder lock. In this case, for example, a compartment is to be opened or closed only with a key. If locking is not needed, the compartment can be kept closed using some known latch structure having no lock. In this case, the compartment can be opened or closed manually without a key. In many installation sites are therefore installed two different locking means: a lock and a latch. A latch is, for example, for daytime use, when it is desired for the compartment or equivalent to be opened or closed without a key.

There are also different push button locks to be used with a key. In these locks, the locking is to be opened with a key. The push button feature moves the latch of the lock in the direction of the longitudinal axis of the lock between the locking position and the releasing position. Such a solution is not necessarily suitable for all installation sites.

US 20110120200 discloses a lock intended for locking compartments and boxes, which is to be locked and opened with a key or by pushing the lock cylinder. This solution has therefore two different operation modes: locking and opening with a key and closing and opening by push button operation. This solution has the advantage that, at those times, when the compartment box does not need to be locked, push button operation can be used. At those times, such as at night, when locking is needed, the compartment can be locked with a key. In this solution, it is however difficult for a user to observe, especially further from the lock, whether a key is needed for opening. In this case, the user may needlessly fetch the key, even though the lock would have been opened with push button operation.

BRIEF DESCRIPTION OF THE INVENTION

The object of the invention is to provide a solution, which removes the limitations of prior known art. A cylinder lock according to the invention has key operation for locking and opening, as well as rotary knob operation for moving the cylinder lock into the closed position and into the releasing position. The inventive cylinder lock further has a clear indication arrangement, which very clearly indicates, in which operation mode the cylinder lock is. The cylinder lock has a rotary knob, which moves upward from the front surface of the cylinder lock, when the locking of the cylinder lock is opened and the cylinder lock is rotated into the releasing position. The rotary knob can be rotated in the ejected position to close or open the compartment, box or other equivalent. Thus, the releasing state of the cylinder lock (i.e. the cylinder lock is unlocked) is clearly visible. The user does not need to fetch a key, because he sees from the ejected rotary knob that the cylinder lock can be closed and opened without a key.

LIST OF FIGURES

Figure 2:
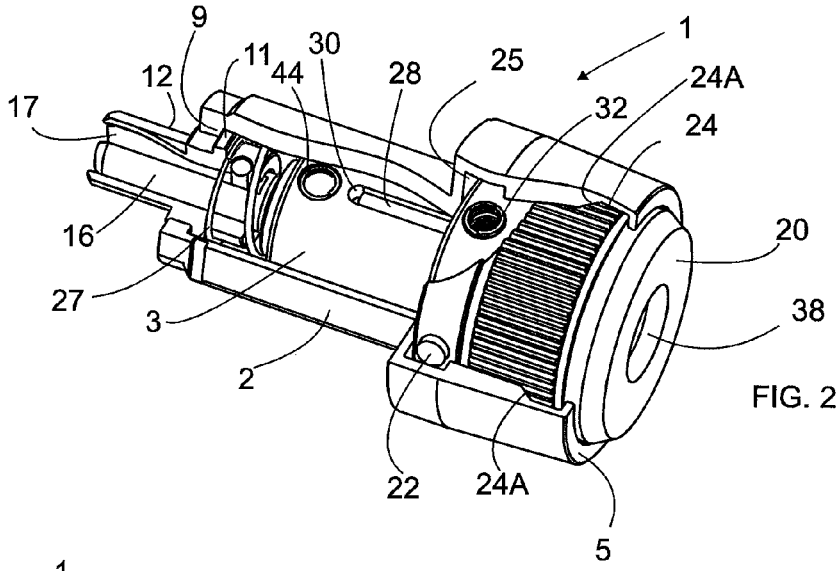
Figure 3:
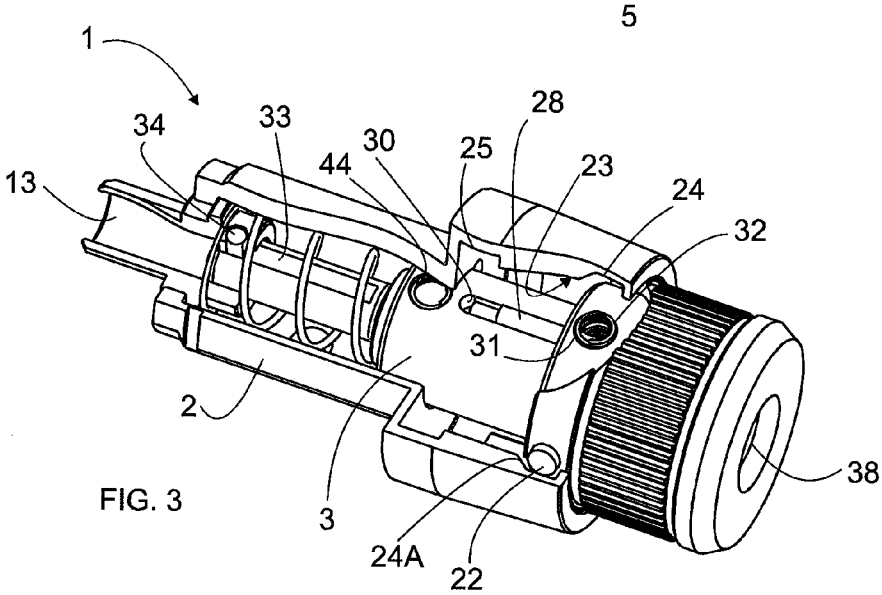
Figure 8:
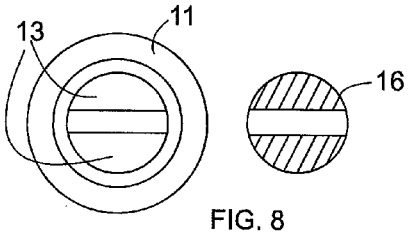
Figure 9:
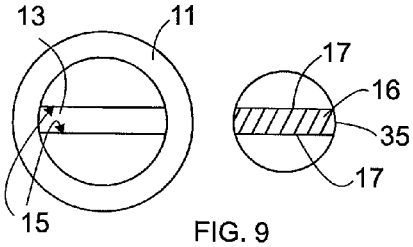
Figure 10:
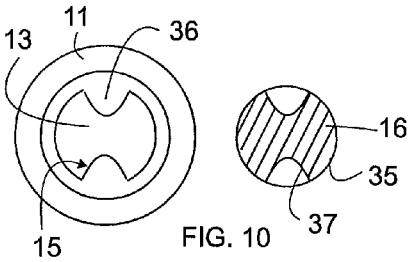
Figure 11:
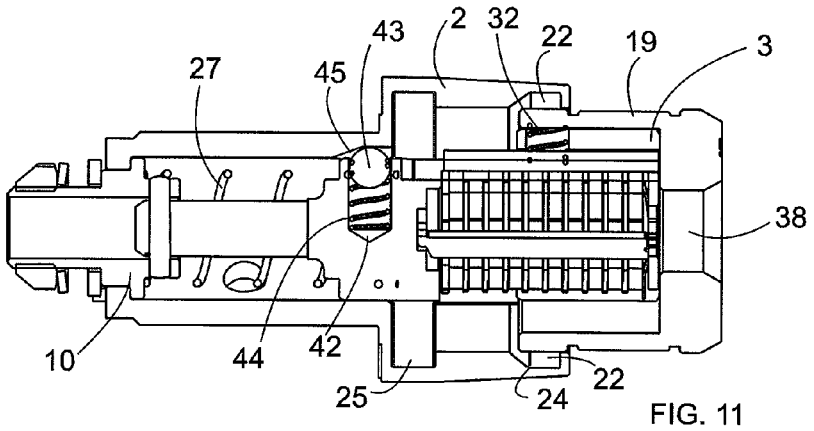
Figure 12:
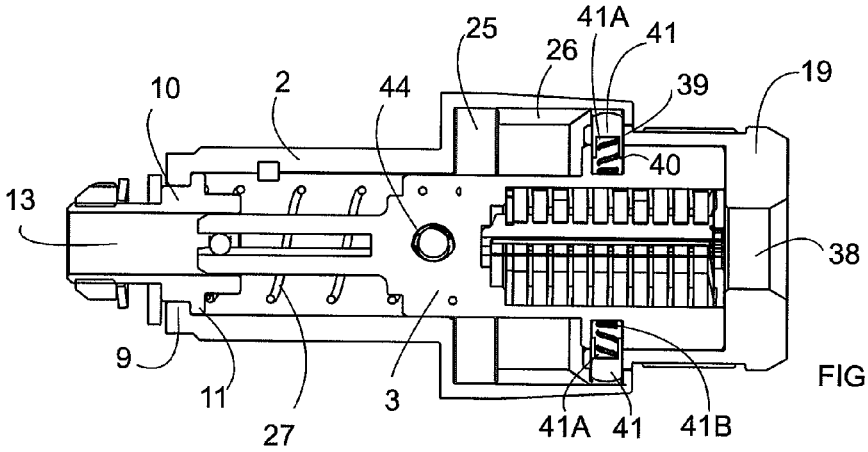
Figure 13:
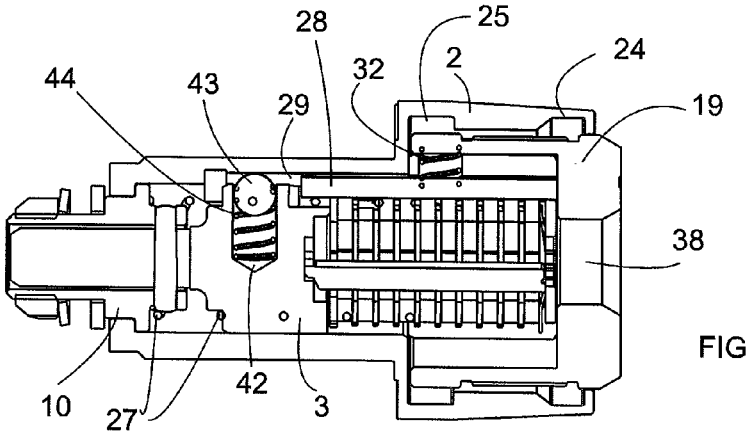

In the following, the invention is described in more detail by means of the accompanying figures, in which FIG. 1 shows an exploded view example of a cylinder lock according to the invention, FIG. 2 shows a sectional diagram example of a cylinder lock according to the invention in the locking state, FIG. 3 shows a sectional diagram example of a cylinder lock according to the invention in the releasing state and as closed, FIGS. 4-7 show the operation of a cylinder lock according to the invention in its different states, FIGS. 8-10 show various ways of implementation of the parts of the inventive cylinder lock, FIG. 11 shows a sectional diagram example of a cylinder lock according to the invention presenting the position indication parts of the inner cylinder, FIG. 12 shows another sectional diagram example of a cylinder lock according to the invention presenting the grooves of the inner surface of the cylinder body, and FIG. 13 shows a sectional diagram example of a cylinder lock according to the invention as locked.

DESCRIPTION OF THE INVENTION

FIG. 1 shows an exploded view example of a cylinder lock according to the invention. The cylinder lock 1 comprises a cylinder body 2, an inner cylinder 3 and a rotating part 4 (FIGS. 4-7). The cylinder body 2 has a front end 5 and an open rear end 6. The inner cylinder 3 has a base 7, and the inner cylinder is placed to the inside of the cylinder body 2 and provided with tumblers 8, which, in blocking positions, block rotation of the inner cylinder 3 in relation to the cylinder body 2 and allow rotation of the inner cylinder 3 in relation to the outer cylinder, when the tumblers 8 are moved into releasing positions. The rotating part 4 is on the side of the rear end 6 of the cylinder body and in connection with the base 7 of the inner cylinder.

The cylinder lock can be a disc tumbler cylinder lock or a pin tumbler cylinder lock. The cylinder lock can therefore be implemented utilizing known cylinder lock structures. In the embodiment of FIG. 1, the tumblers are disc tumblers. Depending on the type of cylinder, it can comprise spacer discs 8A between the tumbler discs 8 and also a guide 8B in the key canal formed by the central openings of the tumbler discs. The inner cylinder can comprise a lateral section for possible outer circumference projections of the tumbler discs. In some cylinder locks, in a known manner, the base of the cylinder body is open, as it also is in the cylinder lock according to the invention.

The rear end 6 of a cylinder body according to the invention comprises an inner flange portion 9 around the open portion 6A of the rear end, and the cylinder lock comprises a rotating pin 10, which has an outer flange 11 and a shaft 12. The shaft is provided with a centre hole 13. The outer surface of the shaft has attachment surfaces 14, onto which the rotating part 4 can be attached such that it rotates along with the rotating pin. FIG. 1 also shows an attachment nut 4A, and washers 4B, 4C, which are used to attach the rotating part 4 onto the shaft 12. The rotating pin is placed through the open rear end 6, when the outer flange 11 is against the inner flange portion 9 of the rear end. The centre hole 13 of the shaft of the rotating pin 10 is provided with torsional surfaces 15.

The base 7 of the inner cylinder has a connecting shaft 16, which is provided with corresponding torsional surfaces 17. The inner cylinder 3 is axially slidable in relation to the cylinder body 2, wherein the corresponding torsional surfaces 17 of the connecting shaft 16 are against the torsional surfaces 15 of the rotating pin 10 regardless of the axial location of the inner cylinder 3. The inner cylinder is therefore always in connection with the rotating pin 10 and via the rotating pin with the rotating part 4. Because the rotating pin is rotatably connected into the cylinder body 2 at the site of its open rear end 6 such that the rotating pin does not move axially, the rotating part 4 attached to the rotating pin also does not move axially. The rotating part can be a latch, as FIGS. 4-7 show. That the rotating part/latch does not move axially, is in many usage sites (boxes, compartments etc.) a desired characteristic, as it is not desired that the latch move vertically in relation to the front surface of the object to be locked. The rotating part can also be another rotating part than what FIGS. 4-7 show, for example, a rotating notchless metal plate.

The front part 18 of the inner cylinder is provided with a rotary knob 19, which has a front surface 20 and a side surface 21 with a projection 22 (FIGS. 2 and 3). The projection is arranged to flexibly press against the side surface 21 of the rotary knob. In some cylinder types, the rotary knob can be implemented as an integral part of the inner cylinder. From the viewpoint of manufacture of the lock cylinder, it is, however, preferable that the rotary knob is a separate part, which is attached to the front part of the inner cylinder. In this manner, assembly of the cylinder lock is facilitated.

The inner surface 23 of the cylinder body is provided with first 24 and second 25 circumferential grooves (FIGS. 2 and 3) and a connecting groove 26 connecting them (FIG. 12) in the direction of the shaft of the inner cylinder. The inner edge 24A of the first circumferential groove 24, i.e. the edge on the side of the second circumferential groove 25, is bevelled. There is at least 1 connecting groove. The first circumferential groove 24 is in the vicinity of the front end 5, and the second circumferential groove 25 is closer to the rear end 6 than the first circumferential groove 24. The lock cylinder further comprises a spring 27 between the base of the inner cylinder and the rotating pin 10. The spring attempts therefore to push the inner cylinder and the rotary knob outwards in relation to the front surface 5 of the cylinder body.

Figure 4:
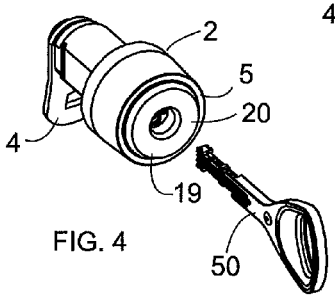
Figure 5:
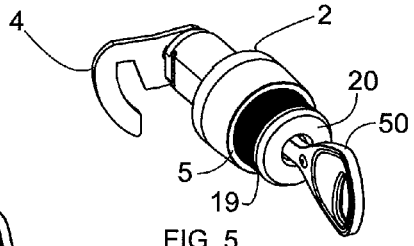

FIGS. 4-7 illustrate the operation of a cylinder lock according to the invention. The cylinder lock 1 is in the locked position, when the tumblers 8 are in the blocking position and the projection 22 of the rotary knob is on the second circumferential groove 25 (FIGS. 2 and 3). In the locked state, the front surface 20 of the rotary knob is near the front end 5 of the cylinder body, as FIG. 4 shows. The locking can be opened in the normal manner with a key 50, wherein the latch 4 can be rotated into the open position (unlocked position), as FIG. 5 shows.

Figure 6:
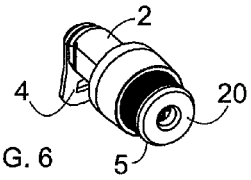
Figure 7:
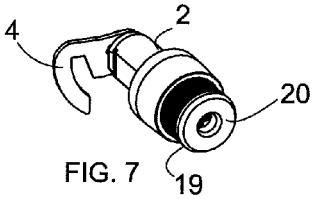

The lock cylinder is in the unlocked state, when the tumblers 8 are in the releasing positions (do not block rotating of the inner cylinder 3 in relation to the cylinder body) and the inner cylinder 3 is rotated into the unlocked position (the position of FIG. 5, in which the latch is also in the open position), wherein the projection 22 of the rotary knob is at the site of the connecting groove 26. In this case, the spring 27 is free to push the rotary knob 19 and the inner cylinder 3 into the extended position in relation to the front end 5 of the cylinder body (FIG. 5). In the extended position, the rotary knob 19 and the inner cylinder 3 are to be rotated such that the projection 22 of the rotary knob moves along the first circumferential groove 24. In the extended, i.e. ejected position, the inner cylinder and the rotating part/latch 4 connected therein via the rotating pin 10 can be rotated between the open position (FIG. 7) and the closed position (FIG. 6). In the ejected position of the rotary knob, the cylinder lock is therefore in the releasing position, if it can without a key be rotated by hand to open and close the compartment. As FIGS. 5 and 6 show, the key can be removed from the cylinder lock, when the rotary knob is in the ejected position.

The ejected rotary knob indicates clearly that a key is not necessary for using the cylinder lock. The box, compartment etc. can be closed and opened by twisting the rotary knob. When it is desired to lock the box or equivalent, the key 50 is used. The key is inserted into the cylinder lock and it is rotated such that the projection 22 of the rotary knob is at the site of the connecting groove 26 and pushing the rotary knob inside the cylinder lock is possible. When the rotary knob is pushed inside, the cylinder lock can be locked by rotating the key.

The bevelled inner edge 24A of the first circumferential groove 24 and inwardly pressing projection 22 also provide locking without a key. When the cylinder lock is in a position according to FIG. 6, i.e. the latch 4 is shut, the rotary knob 19 can be pressed inside the cylinder lock, wherein the cylinder lock is locked, and the rotary knob remains in the cylinder lock, because the projection 22 protrudes as pushed by the spring 41B (FIG. 12) into the second circumferential groove 25. In the initial stage of the pushing of the rotary knob, the bevelled inner edge 24A of the first circumferential groove guides the projection 22 to press towards the side surface 21 of the rotary knob.

FIGS. 2 and 3 show structures of the cylinder lock, when it is locked (FIG. 2) and released from locking (FIG. 3). From the viewpoint of usage, it is convenient that the part 18 of the inner cylinder 3 provided with the rotary knob is in diameter larger than the rest of the inner cylinder. In this case, the rotary knob is easier to use. Additionally, the structure is more massive and thus more durable. As can be observed from the presented figures, the rotary knob 19 has a key hole 38 in the middle of its front surface 20. It is good for the rotary knob 19 to be cup-like in structure, wherein it protects the inner cylinder also in the ejected position. To the inside of the cylinder body is arranged space also for the rotary knob. The side surface 21 of the rotary knob is provided with at least one pin hole 39 (FIG. 12) and the inner cylinder with at least one corresponding pin hole 40. In such an embodiment, the cylinder lock comprises at least one pin 41, which is placed into the pin hole 39 and into the corresponding pin hole 40. In this example, the pin forms said projection 22. The pin has a recess 41A, into which is placed the flexible spring 41B to push the pin outward from the side surface 21 of the rotary knob 19. The flexible spring of the example therefore pushes the pin away from the side surface of the rotary knob and, at the same time, allows the pressing of the pin against the side surface of the rotary knob. Some other flexible part can also be used in place of the flexible spring, such as a piece of rubber.

In the embodiment of FIG. 12, there are two pins, wherein are also needed two connecting grooves 26 in order that the projections 22 formed by the pin are free to move in the axial direction of the cylinder lock (in the longitudinal direction/the direction of the connecting shaft 16). The rotary knob 19 can also be attached in a manner other than with an attachment pin into the inner cylinder 3, for example, with a locking ring.

If the cylinder lock is a disc tumbler cylinder lock, it can comprise a tumbler bar 28 between the cylinder body and the tumblers, wherein the tumblers 8 therefore are disc tumblers. FIGS. 11-13 illustrate such a disc tumbler cylinder structure. The cylinder body 2 has, in this case, a tumbler bar groove 29, and the inner cylinder has a tumbler bar notch 30. The inner cylinder 3 is further provided with a spring recess 31 and a second spring 32, which is placed in the spring recess. The second spring is arranged to push the tumbler bar 28 towards the tumbler discs 8. When the inner cylinder and rotary knob are in the ejected position (FIGS. 11 and 12), the second spring 32 pushes therefore the tumbler bar towards the tumbler discs, wherein the tumbler bar 28 does not form a barrier for pushing the rotary knob 19 and inner cylinder 3 back inside the cylinder body (FIG. 13). The disc tumblers and tumbler bar operate in a manner known per se to achieve the locking and to open the locking, so their operation is not described in more detail in this connection.

The connecting shaft 16 of the inner cylinder can be implemented in various ways. It can comprise a notch 33 in the direction of its shaft, the side surfaces 17 of which form said corresponding torsional surfaces. In this embodiment, the centre hole 13 of the shaft 12 of the rotating pin 10 is provided with a bar 34, transverse in relation to the axial direction, which forms said torsional surfaces 15. The bar is attached into the holes 10A in the rotating pin. FIGS. 1 and 8 show such an implementation.

The connecting shaft can also be implemented such that the outer surface 35 of the connecting shaft 16 comprises said corresponding torsional surfaces 17, and, in this case, the surface of the centre hole 13 of the shaft of the rotating pin 10 comprises said torsional surfaces 15. FIG. 9 shows an implementation, in which the centre hole 13 and the connecting shaft 16 are rectangular in their basic shape. FIG. 10 shows an embodiment, in which the surface of the centre hole 13 has at least one projection 36 towards the centre of the centre hole and the surface of the connecting shaft 16 has at least one groove 37. As can be observed from above said figures, the centre hole of the rotating pin 10 and the connecting shaft can be implemented in many various ways. The centre hole 13 can also be, for example, oval as can the profile of the connecting shaft 16.

The inner cylinder 3 can comprise a ball recess 42, a ball 43 and a third spring 44, which spring 44 and ball 43 are placed into the ball recess 42. The cylinder body 2 comprises an indication recess 45. The third spring pushes the ball towards the cylinder body, and the ball recess and ball are in the unlocked position at the site of the indication recess. The location of the ball in the indication recess is observable, when the rotary knob is twisted by hand. The ball/indication recess structure further prevent rotating of the rotary knob and the inner cylinder due to external vibration or corresponding. For example, in boxes and storages of boats and ships which are to be locked, vibration can unintentionally rotate the position of the cylinder lock.

The invention provides a solution, with which a storage, compartment etc. is to be closed and opened without a key or with a key. The storage is, at the same time, to be locked with a key or without a key. A separate latch is not needed. The invention also indicates quite prominently, whether the cylinder lock is to be used without a key, wherein the storage can be closed and opened just by hand. This is a trait longed for particularly, for example, in boats, in which storages and compartments are constantly opened during a trip, wherein using a key for opening and closing would be laborious. Also in offices, many lockers are intended to be closed and opened constantly during the daytime, but it is desired to lock them at night.

In light of the examples presented above, it is obvious that the embodiment according to the invention can be achieved by many various solutions so it can be implemented by many different embodiments within the scope of the inventive idea.

The invention claimed is:

1. A cylinder lock comprising:

a cylinder body, having a front end an open rear end, the rear end comprising an inner flange portion around an open portion of the open rear end;

an inner cylinder, having a base and being placed inside the cylinder body and being provided with tumblers, which, in the blocking positions, block rotation of the inner cylinder and of the inner cylinder in relation to the outer cylinder, when the tumblers are moved into releasing positions;

a rotating part on a side of the rear end of the cylinder body and in connection with the base of the inner cylinder;

a rotating pin having an outer flange and a shaft, which is provided with a center hole and attachment surfaces on outer surface of the shaft, said rotating pin being placed through the open rear end, the outer flange being against the inner flange portion of the rear end, and onto which attachment surfaces the rotating part is attached, the center hole of the shaft of which rotating pin is provided with torsional surfaces; and a spring between the base of the inner cylinder and the rotating pin, wherein said base of the inner cylinder has a connecting shaft, which is provided with corresponding torsional surfaces, said inner cylinder is axially slidable in relation to the cylinder body, the corresponding torsional surfaces of the connecting shaft being against the torsional surfaces of the rotating pin regardless of the axial location of the inner cylinder, the front part of said inner cylinder is provided with a rotary knob, which has a front surface and a side surface with a projection, which is arranged to flexibly press against the side surface, wherein the inner surface of said cylinder body is provided with first and second circumferential grooves and a connecting groove connecting them in the direction of the shaft of the inner cylinder, the first circumferential groove being in the vicinity of the front end and the second circumferential groove being closer to the rear end than the first circumferential groove, the inner edge of the first circumferential groove being bevelled, wherein said cylinder lock is in the locked state, when the tumblers are in the blocking position and the projection of the rotary knob is on the second circumferential groove, in which locked state the front surface of the rotary knob is close to the front end of the cylinder body, and wherein said lock cylinder is in the unlocked state, when the tumblers are in the releasing positions and the inner cylinder is rotated into the unlocked position, wherein the projection of the rotary knob is at the site of the connecting groove, wherein the spring is free to push the rotary knob and the inner cylinder into the extended position in relation to the front end of the cylinder body, in which extended position the rotary knob and the inner cylinder are rotatable such that the projection of the rotary knob moves along the first circumferential groove.

2. A cylinder lock according to claim 1, wherein the part of the inner cylinder provided with a rotary knob is in diameter larger than the rest of the inner cylinder.

3. A cylinder lock according to claim 1, further comprising a tumbler bar between the cylinder body and the tumblers and the tumblers are disc tumblers, said cylinder body has a tumbler bar groove, and the inner cylinder has a tumbler bar notch, said inner cylinder is further provided with a spring recess and a second spring, which is attached into the spring recess, said second spring is arranged to push the tumbler bar towards the tumbler discs.

4. A cylinder lock according to claim 3, wherein the connecting shaft comprises a notch, the side surfaces of which form said corresponding torsional surfaces, and the center hole of the shaft of which rotating pin is provided with a bar transverse in relation to the axial direction, which forms said torsional surfaces.

5. A cylinder lock according to claim 3, wherein the outer surface of the connecting shaft comprises said corresponding torsional surfaces, and the surface of the center hole of the shaft of which rotating pin comprises said torsional surfaces.

6. A cylinder lock according to claim 5, wherein the center hole and the connecting shaft are rectangular in their basic shape.

7. A cylinder lock according to claim 5, wherein the surface of the center hole has at least one projection towards the center of the center hole, and the surface of the connecting shaft has at least one groove.

8. A cylinder lock according to claim 1, wherein the rotary knob has a key hole in the middle of a front surface of the key hole.

9. A cylinder lock according to claim 7, wherein the rotary knob is cup-like in shape, and its side surface is provided with at least one pin hole and the inner cylinder with at least one corresponding pin hole, and said cylinder lock comprises at least one pin, which is placed into the pin hole and into the corresponding pin hole, said pin forms said projection, said pin has a recess, in which is placed a flexible spring to push the pin outward from the side surface of the rotary knob.

10. A cylinder lock according to claim 1, wherein the inner cylinder comprises a ball recess, a ball and a third spring, said spring and ball are placed into the ball recess, and the cylinder body comprises an indication recess, said spring pushes the ball towards the cylinder body and, in the unlocked position, the ball recess and ball are at the site of the indication recess.

11. A cylinder lock according to claim 1, wherein the rotating part is a latch.

* * * * *